US007053742B2

(12) United States Patent
Lanni et al.

(10) Patent No.: US 7,053,742 B2
(45) Date of Patent: May 30, 2006

(54) ELECTROMAGNETIC ACTUATOR HAVING A HIGH INITIAL FORCE AND IMPROVED LATCHING

(75) Inventors: Arthur Lanni, Cary, NC (US); Marty L. Trivette, Cary, NC (US); Varagur R. Ramanan, Cary, NC (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 10/934,543

(22) Filed: Sep. 4, 2004

(65) Prior Publication Data

US 2005/0093664 A1 May 5, 2005

Related U.S. Application Data

(63) Continuation-in-part of application No. 10/041,001, filed on Dec. 28, 2001, now Pat. No. 6,950,000.

(60) Provisional application No. 60/500,629, filed on Sep. 5, 2003.

(51) Int. Cl.
*H01F 7/08* (2006.01)

(52) U.S. Cl. ..... 335/220; 335/262

(58) Field of Classification Search ..... 335/220–236, 335/250–251, 261–262, 270–282; 251/129.01–15, 251/129.1–19
See application file for complete search history.

(56) References Cited

U.S. PATENT DOCUMENTS 506,282 A * 10/1893 Timmis ..... 335/261
3,022,450 A 2/1962 Chase, Jr.
3,545,472 A 12/1970 Franz
3,792,390 A 2/1974 Boyd
3,805,204 A 4/1974 Petersen
3,860,894 A 1/1975 Popovic et al.
3,987,385 A 10/1976 Diller et al.
4,072,918 A 2/1978 Read, Jr.
4,218,669 A 8/1980 Hitchcock et al.
4,236,130 A 11/1980 Hubert
4,321,570 A 3/1982 Tsunefuji
4,442,418 A 4/1984 Myers
4,443,775 A 4/1984 Fujitani et al.
4,491,816 A * 1/1985 Blum ..... 335/245
4,602,233 A 7/1986 Pavlovsky et al.
4,633,209 A * 12/1986 Belbel et al. ..... 335/261
4,664,136 A 5/1987 Everett
4,683,452 A 7/1987 Henley
4,686,501 A 8/1987 Palmier et al.
4,711,266 A 12/1987 Leiber
4,812,795 A 3/1989 Zabar
4,812,884 A 3/1989 Mohler
4,835,503 A 5/1989 Everett
4,859,975 A 8/1989 Uetsuhara
5,110,087 A 5/1992 Studtmann et al.
5,202,658 A 4/1993 Everett et al.
5,515,818 A 5/1996 Born
5,547,165 A 8/1996 Brehm et al.
5,864,274 A * 1/1999 Steingroever et al. ..... 335/234
5,912,604 A 6/1999 Harvey et al.
6,125,803 A 10/2000 Hattori et al.
6,198,605 B1 3/2001 Briggs et al.
6,816,048 B1 11/2004 Morita et al.
2002/0121828 A1 9/2002 Ketschau et al.

* cited by examiner

*Primary Examiner*—Lincoln Donovan
(74) *Attorney, Agent, or Firm*—Paul R. Katterle

(57) ABSTRACT

An electromagnetic actuator is provided that comprises a housing, a solenoid coil, and an armature. The armature is movably disposed in an interior cavity defined by the housing. Irregular gaps are formed between the armature and the housing to increase the initial force of the actuator and to improve the latching force of the actuator after the actuator has been actuated.

15 Claims, 9 Drawing Sheets

ELECTROMAGNETIC ACTUATOR HAVING A HIGH INITIAL FORCE AND IMPROVED LATCHING

CROSS-REFERENCE TO RELATED APPLICATIONS

This application is a continuation-in-part of U.S. patent application Ser. No. 10/041,001 filed on Dec. 28, 2001 now U.S. Pat. No. 6,950,000 and claims the benefit of U.S. provisional patent application No. 60/500,629 filed on Sep. 5, 2003. Both U.S. patent application Ser. No. 10/041,001 and U.S. provisional patent application No. 60/500,629 are hereby incorporated by reference in their entirety.

FIELD OF THE INVENTION

The invention relates to electromagnetic actuators, and more particularly, to high initial force electromagnetic actuators.

BACKGROUND OF THE INVENTION

An electromagnetic actuator is a device that converts electrical energy into mechanical movement. It consists primarily of two parts, a solenoid coil and an armature. Generally, the coil is formed from wire that has been wound into a cylindrical shape. The armature is typically mounted to move or slide axially with respect to the cylindrically shaped coil. An electrical signal applied to the coil generates an electromagnetic field that imparts a force on the armature, thereby causing the armature to move.

An electromagnetic actuator may be used to actuate a mechanism, for example, a valve, a circuit breaker, a recloser, a switchgear, and the like. Each mechanism needs a certain amount of force to operate the mechanism. Further, many of the mechanisms have a limited amount of space to contain the electromagnetic actuator and therefore, electromagnetic actuators are often designed to have a low profile to fit into a limited amount of space. Often, such low profile actuators cannot provide enough force to actuate the mechanism.

Consequently, a need exists for a low profile electromagnetic actuator that is capable of generating sufficient force to actuate a mechanism.

SUMMARY OF THE INVENTION

The invention is directed to an electromagnetic actuator having an increased initial force and improved latching force.

These and other features of the invention will be more fully set forth hereinafter.

In accordance with one aspect of the present invention, an electromagnetic actuator is provided and includes a housing, a solenoid coil and an armature. The housing has an end wall and defines a cavity. The end wall has non-coplanar first and second surfaces. The solenoid coil is disposed in the cavity of the housing. The armature is disposed disposed substantially coaxially with the solenoid coil. The armature is movable between a first position disposed proximate to the end wall of the housing and a second position disposed distal to the end wall of the housing. The armature has opposing first and second ends. The first end is disposed toward the end wall of the housing and has non-coplanar first and second surfaces. The second surface of the armature is disposed closer to the second end than the first surface of the armature. When the armature is in the first position, the first surface of the end wall of the housing is disposed closer to the second end of the armature than the first surface of the first end of the armature.

In accordance with one aspect of the present invention, an electromagnetic actuator is provided that includes a housing defining a cavity, a shaft, a solenoid coil, a clamp surface, an armature and an extension member. The shaft extends through the housing and has a longitudinal axis. The solenoid coil is disposed in the cavity of the housing and has a center axis that is substantially coaxial with the longitudinal axis of the shaft. The armature is secured to the shaft and extends radially outward from the shaft to an outer peripheral surface. The armature is positioned such that the clamp surface is disposed between the solenoid coil and the armature. The armature is movable between a first position disposed proximate to the clamp surface and a second position disposed distal to the clamp surface. When the armature is in the second position, the armature and the clamp surface define a first gap therebetween. The first gap has a width in the direction of the longitudinal axis of the shaft. The extension member extends in the direction of the longitudinal axis of the shaft to delimit the first gap in a direction radially outward from the longitudinal axis of the shaft. The extension forms a second gap with the housing or the armature. The second gap has a plurality of different widths that extend in directions radially outward from the longitudinal axis of the shaft. These widths are all smaller than the width of the first gap.

BRIEF DESCRIPTION OF THE DRAWINGS

The invention is further described in the detailed description that follows, by reference to the noted drawings by way of non-limiting illustrative embodiments of the invention, in which like reference numerals represent similar elements throughout the several views of the drawings, and wherein.

DETAILED DESCRIPTION OF ILLUSTRATIVE EMBODIMENTS

As described above, many low profile electromagnetic actuators cannot provide enough force to actuate a particular mechanism. Increasing the initial force of an actuator, however, may provide enough force to actuate the mechanism. That is, if the electromagnetic actuator can be configured to provide a higher initial force, the resultant increased acceleration and inertia may be sufficient to actuate the mechanism. As such, the invention is directed to an electromagnetic actuator having an increased initial force.

Figure 1:
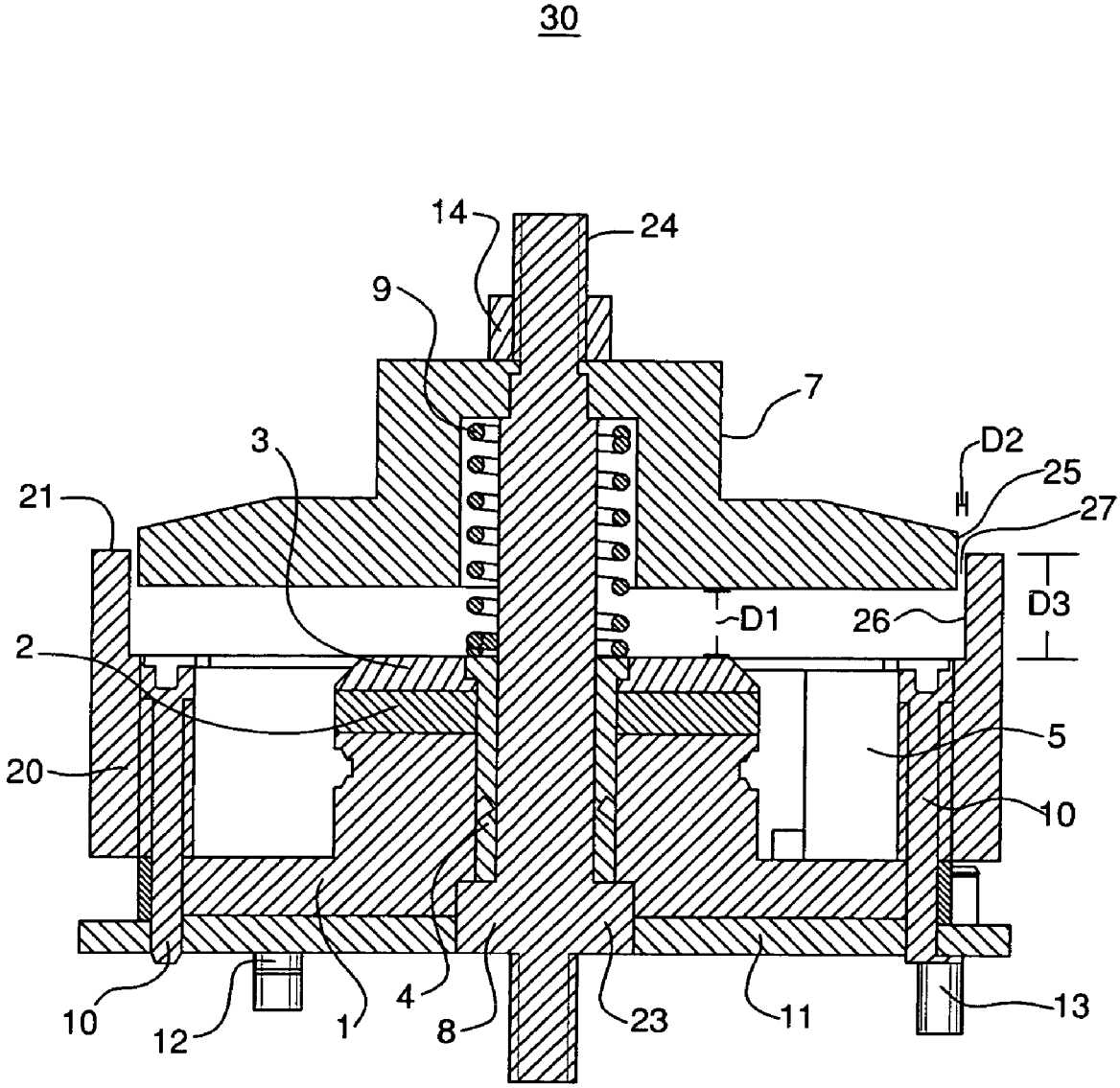
FIG. 1 is a cut-away view of an illustrative electromagnetic actuator in the open position, in accordance with an embodiment of the invention.

FIG. 1 is a cut-away view of an illustrative electromagnetic actuator in the open position, in accordance with an embodiment of the invention. As shown in FIG. 1, actuator 30 comprises a solenoid coil 5, a shaft 8, an armature 7, and a housing 20.

Solenoid coil 5 comprises a conductor wound into a cylindrical shape and lead wires (not shown) for connection of electrical power to the conductor. Connection of electrical power to solenoid coil 5 creates a magnetic field that exerts a force on some materials. The greater the number of conductor turns wound in solenoid coil 5, the greater the force exerted when the solenoid coil is energized. The direction of force depends on the polarity of electrical power applied to the lead wires. For example, applying positive voltage to the leads may result in an upward force on armature 7 and applying negative voltage may result in a downward force on armature 7. The strength of the force also depends on the stroke of armature 7. That is, when armature 7 is located distal of solenoid coil 5, the electromagnetic force on armature 7 is weaker than when armature 7 is proximate solenoid coil 5.

As shown, solenoid coil 5 is disposed between a base plate 11 and a clamp plate 3 and within a cavity defined by housing 20. Base plate 11 is substantially planar; however, base plate 11 may be any shape that secures solenoid coil 5 within housing 20. Base plate 11 comprises threaded holes for receiving fasteners 10 for securing clamp plate 3 and housing 20 to base plate 11; however, other fastening techniques are contemplated. Base plate 11 has a passage for receiving shaft 8; however, such passage may not be included if shaft 8 does not extend past base plate 11.

Base plate 11 extends beyond housing 20 for mounting electromagnetic actuator 30 to another device, such as for example, a valve, a circuit breaker, a recloser, a switchgear, and the like. Base plate 11 has holes for fasteners 12 and fasteners 13. While fasteners 12 and 13 are illustrated as countersunk screws and socket head screws, respectively, other fasteners and other mounting techniques are contemplated.

Core 1 comprises magnetically permeable material and is substantially annular shaped. Core 1 has an annular recess for receiving solenoid coil 5 and an axial passage for receiving a bushing 4; however, core 1 may be any shape to provide a magnetic circuit for solenoid coil 5. Core 1 has through-holes for receiving fasteners 10; however, core 1 may not include through-holes if fasteners 10 are located outside of core 1. Core 1 is disposed on base plate 11 with its axial passage aligned with the passage of base plate 11 and with its through holes aligned with the threaded holes of base plate 11.

Permanent magnet 2 is substantially annularly shaped and has an axial passage for bushing 4; however, permanent magnet 2 may be any suitable shape. Permanent magnet 2 is aligned such that its magnetic poles provide a magnetic force biasing armature 7 towards solenoid coil 5. The force is strongest when permanent magnet 2 is proximate armature 7 and weakest when permanent magnet 2 is distal of armature 7. Permanent magnet 2 is disposed on core 1, typically proximate armature 7 to provide increased magnetic force on armature 7. Permanent magnet 2 is used with one technique for stroking actuator 30 but may be omitted with other techniques, as described in more detail below.

Housing 20 is substantially annularly shaped and defines a cavity that contains core 1, solenoid coil 5, permanent magnet 2, clamp plate 3, and bushing 4. Housing 20 has through-holes corresponding to the through-holes of core 1 for receiving fasteners 10. Housing 20 is disposed on core 1 with its through-holes aligned with the through-holes of core 1. Housing 20 comprises a substantially annular extension member 21 extending in an axial direction towards armature 7 and beyond solenoid coil 5 and clamp plate 3. Housing 20 and extension member 21 may be any suitable shape that can define a gap with armature 7, as described in more detail below. Extension member 21 may be integrally formed with housing 20 or may be a separate piece attached to housing 20. Such attachment may be, for example, a weld, an adhesive, a fastener, or the like. Extension member 21 is composed of a magnetically permeable material and defines an annular inner surface 26. Extension member 21 provides increased initial magnetic force on armature 7, as described in more detail below.

Clamp plate 3 is substantially annularly shaped and has through-holes corresponding to the through holes of housing 20 and an axial passage corresponding to the passage of permanent magnet 2. Clamp plate 3 may be any suitable shape and may utilize any fastening technique for securing permanent magnet 2, solenoid coil 5, and core 1 within housing 20. Fasteners 10, shown as socket head cap screws, are disposed through the through-holes of clamp plate 3, the through-holes of housing 20, the through-holes of core 1, and are threaded into the threaded holes of base plate 11.

Bushing 4 is substantially cylindrically shaped and is disposed in the passage of core 1, the passage of permanent magnet 2, and the passage of clamp plate 3. Bushing 4 secures shaft 8 such that shaft 8 may move axially.

Shaft 8 is substantially cylindrically shaped and is disposed in bushing 4. Shaft 8 comprises a shaft collar 23 at one end of shaft and threads 24 on the other end of shaft 8. Shaft collar 23 is proximate core 1 and is larger than the passage of core 1 and therefore, limits the axial travel of shaft 8 in one direction. Threads 24 are distal of core 1 and mate with a fastener 14 to limit the axial travel of shaft 8 in the other direction. Fastener 14 is shown as a hex nut engaged to threads 24; however, other fastening techniques are contemplated.

Spring 9 is disposed over shaft 8 between clamp plate 3 and armature 7. Spring 9 is under compression and therefore biases armature 7 away from solenoid coil 5. Spring 9 is sized depending on the technique used for stroking actuator 30, as described in more detail below.

Armature 7 comprises magnetically permeable material and has an outer surface 25. Outer surface 25 may be substantially annularly shaped or may be any other shape suitable for defining a gap with the inner surface of extension member 21. Armature 7 has a passage that receives shaft 8 and is disposed substantially coaxially with solenoid coil 5. Armature 7 is secured to shaft 8 via fastener 14; however, armature 7 may be secured to shaft 8 with other techniques, such as welding and the like. Armature 7 has a cylindrical recess that receives spring 9; however, it is contemplated that armature 7 may not include a recess.

To explain one technique for the operation of electromagnetic actuator 30, FIG. 1 illustrates electromagnetic actuator 30 in the open position (i.e., armature 7 is located distal of solenoid coil 5) with no power being delivered to solenoid coil 5. As can be seen, armature 7 and the body of housing 20 define a gap having a width D1. Also, the outer surface 25 of armature 7 is located a distance D2 from inner surface 26 of housing extension member 21, thereby defining an annular air gap 27 having a width D2. Width D2 is less than width D1, thereby increasing initial force, as described in more detail below.

Spring 9 biases armature 7 away from solenoid coil 5 and permanent magnet 2 biases armature 7 towards solenoid coil 5. Because armature 7 is located distal of permanent magnet 2, the magnetic force from permanent magnet 2 acting on armature 7 is relatively small compared to the mechanical force applied by spring 9. As such, armature 7 remains in the open position, until another force is applied.

Figure 2:
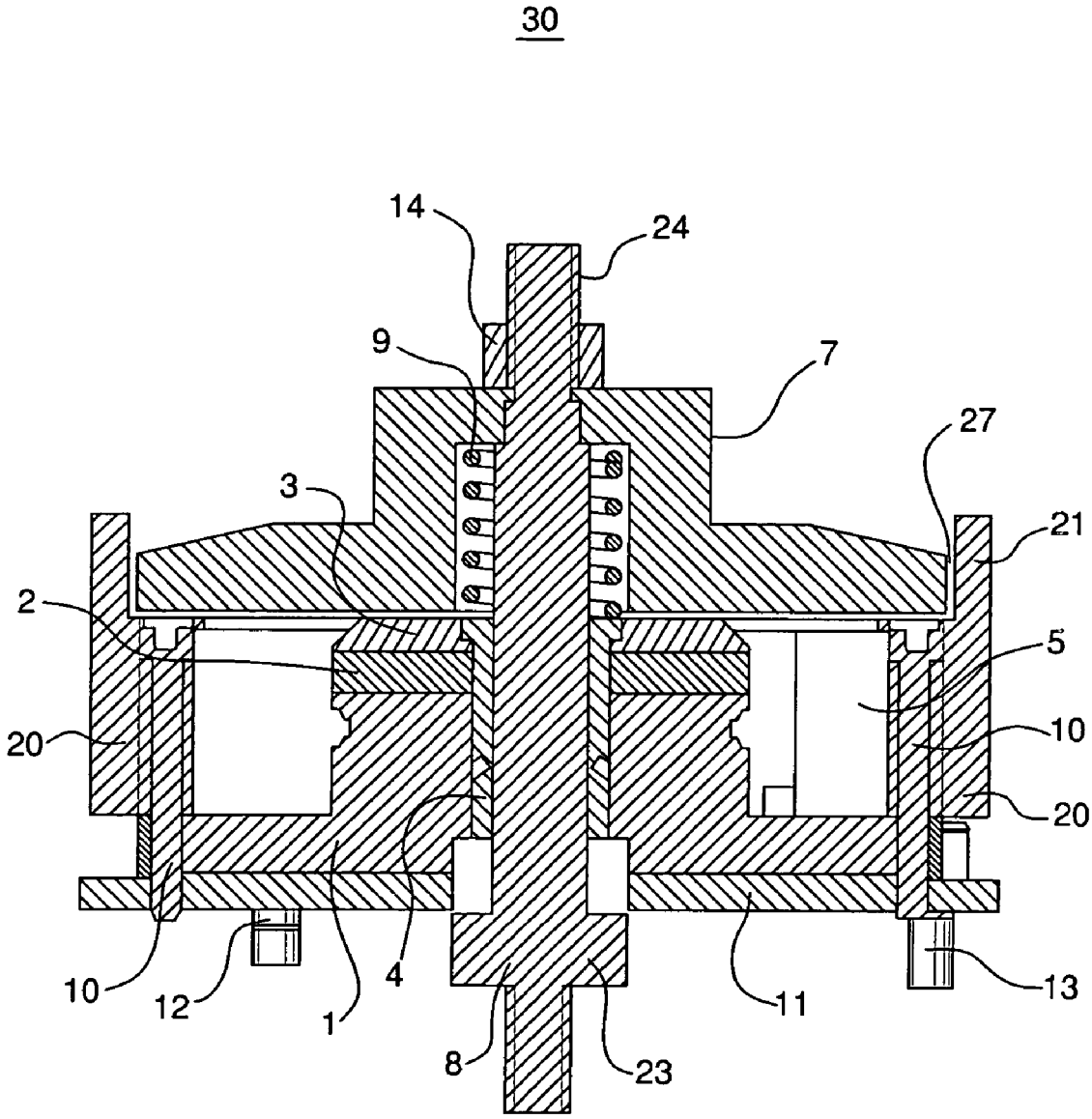
FIG. 2 is a cut-away view of the actuator of FIG. 1 in the closed position.

When a current is applied to solenoid coil 5, a magnetic force acts on armature 7, pulling armature 7 towards solenoid coil 5. To further describe the magnetic force, a magnetic circuit exists around a cross section of solenoid coil 5. That is, a magnetic circuit exists from core 1, through housing 20, housing extension member 21, across air gap 27, through armature 7, across the air gap having width D1, through clamp plate 3 and permanent magnet 2, and back to core 1. The magnetic circuit provides a path for the magnetic flux to create a magnetic force on armature 7. The magnetic force from energized solenoid coil 5 is stronger than the force applied by spring 9 and therefore, armature 7 moves to the closed position, which is illustrated in FIG. 2.

Because extension member 21 extends beyond clamp plate 3 and defines a small annular air gap 27, rather than a large air gap (e.g., an air gap having a width D1), armature 7 moves towards solenoid coil 5 with a higher initial force. As such, electromagnetic actuator 30 may actuate larger mechanisms than if actuator 30 did not have extension member 21. As such, the same size solenoid coil and armature can actuate a larger mechanism than otherwise possible. Extension member 21, therefore, can increase the force delivered by electromagnetic actuator 30 without significantly increasing the space taken by actuator 30.

Once in the closed position, armature 7 remains in the closed position until another force acts on armature 7. Armature 7 remains in the closed position because permanent magnet 2 is now located proximate armature 7 and therefore, exerts a larger force than the opposing force exerted by spring 9. As such, even if power is removed from solenoid coil 5, armature 7 remains in the closed position.

To return armature 7 to the open position, an opposite direction current may be placed on solenoid coil 5. Such current creates a magnetic field that exerts an upward magnetic force on armature 7 that is greater than the downward magnetic force from permanent magnet 2, thereby returning armature 7 to the open position. Armature 7 remains in the open position because permanent magnet 2 is now located distal of armature 7 and therefore, exerts a smaller force than the opposing force exerted by spring 9. As such, even if power is removed from solenoid coil 5, armature 7 remains in the open position.

Different lengths D3 of extension member 21 affect the force-stroke distance characteristic of actuator 30. To illustrate the effect of different lengths of extension member 21, the magnetic force exerted on armature 7 by solenoid coil 5 was calculated for a variety of stroke lengths D1 and a variety of extension member 21 lengths D3 using a finite element analysis software package. The results are summarized in Table 1 below with the forces indicated in Newtons.

TABLE 1

| | D3 = 0 mm | D3 = 12 mm | D3 = 15 mm | D3 = 36 mm |
|---|---|---|---|---|
| D1 = 16 mm (open) | 305 | 563 | 693 | 558 |
| D1 = 14 mm | 394 | 777 | 868 | 688 |
| D1 = 7 mm | 1136 | 1740 | 1693 | 1603 |
| D1 = 0 mm (closed) | 9925 | 10,010 | 9994 | 9965 |

As can be seen, for an electromagnetic actuator 30 that does not have an extension member (i.e., has a length D3=0), the initial force is 305 N. With an extension member 21 having a length D3=12 mm, however, the initial force increases to 563 N. Such an increase in initial force may provide the acceleration and inertia to actuate larger mechanisms without utilizing a larger solenoid coil. Another feature of extension member 21 is that armature 7 may have a substantially constant acceleration, thereby resulting in consistent closing times, which is important in some actuator applications.

Figure 3:
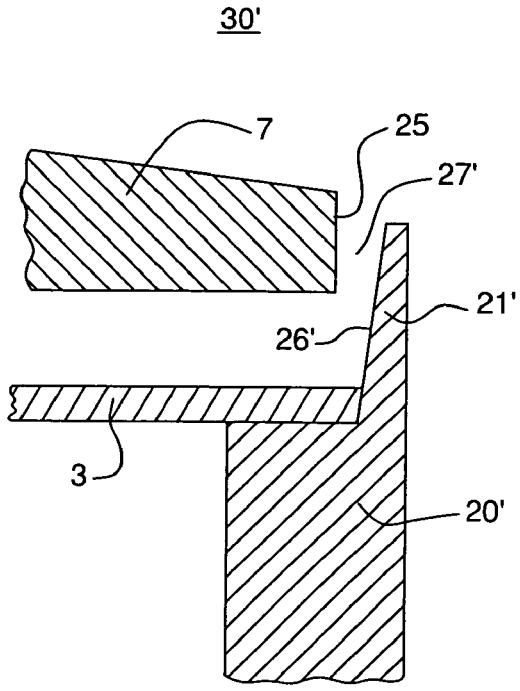
FIG. 3 is a cut-away view of a portion of another illustrative electromagnetic actuator, in accordance with another embodiment of the invention.

Further, the force-displacement curve over the stroke of the actuator may be controlled by varying the shape of air gap 27, for example by varying the length and shape of the extension member. For example, the width of gap 27 can increase with increasing distance from clamp plate 3, such as shown in FIG. 3. As shown, extension member 21' extends from housing 20'. Extension member 21' has an inner annular surface 26' that forms an annular air gap 27'. Air gap 27' becomes wider as the distance from clamp plate 3 increases. With such an air gap, the initial force is less than that of FIG. 1, but increases faster with increasing armature 7 stroke.

Figure 4:
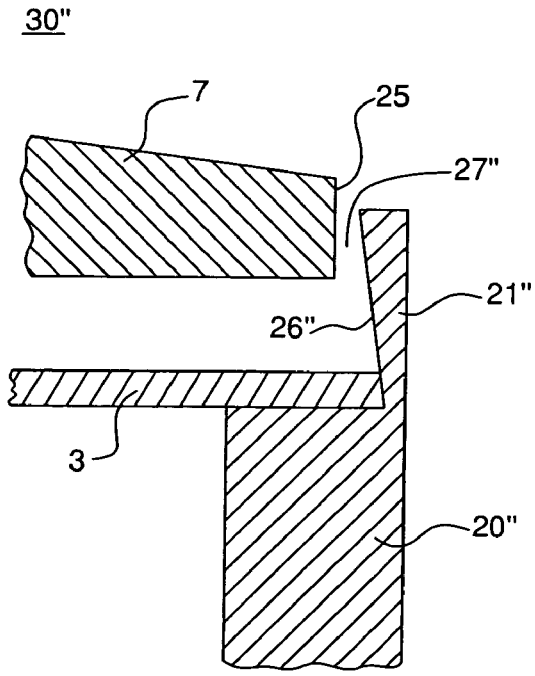
FIG. 4 is a cut-away view of a portion of another illustrative electromagnetic actuator, in accordance with another embodiment of the invention.

FIG. 4 shows another actuator 30". As shown, extension member 21" extends from housing 20". Extension member 21" has an inner annular surface 26" that forms an annular air gap 27". Air gap 27" becomes narrower as the distance from clamp plate 3 increases. While linearly increasing and decreasing air gaps are illustrated, other shaped air gaps are also contemplated, such as for example, curved, saw-tooth shaped, square, and the like.

In FIGS. 3 and 4, the outer surface 25 of the armature 7 is non-parallel to the inner annular surface (26', 26") of the extension member (21', 21"), which provides the air gap (27', 27") with different widths. In addition, in a plane extending in a direction radially outward from the longitudinal axis of the shaft 8, the outer surface 25 of the armature 7 is parallel with the longitudinal axis of the shaft 8 and the inner annular surface (26', 26") of the extension member (21', 21") is non-parallel with the longitudinal axis of the shaft 8.

Further, other techniques for stroking actuator 30 are contemplated. For example, permanent magnet 2 is not required for the operation of actuator 30. If permanent magnet 2 is not included in actuator 30, power is continuously applied to solenoid coil 5 to maintain actuator 30 in the closed position. In another alternate embodiment, spring 9 is in tension and biases armature 7 towards solenoid coil 5.

Figure 5:
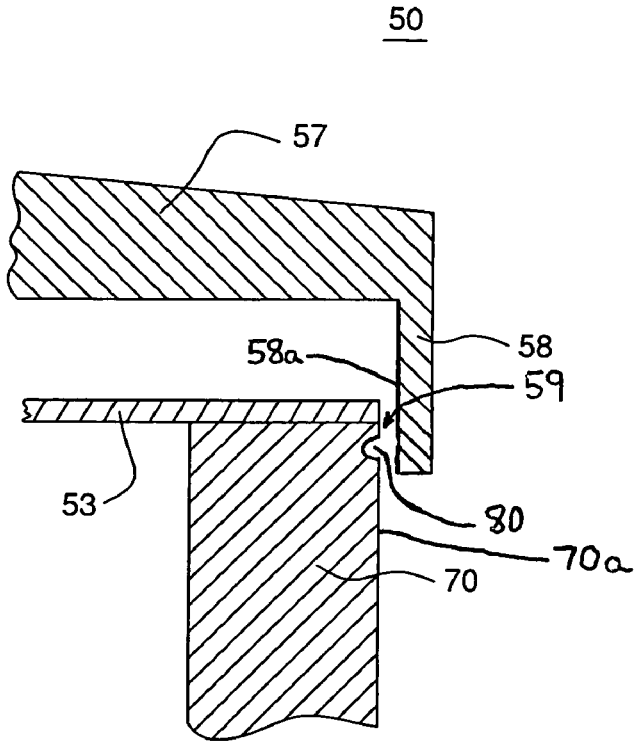
FIG. 5 is a cut-away view of a portion of yet another illustrative electromagnetic actuator, in accordance with another embodiment of the invention.

FIG. 5 shows a portion of another illustrative electromagnetic actuator 50 that is similar to electromagnetic actuator 30. As shown in FIG. 5, electromagnetic actuator 50 comprises a housing 70 and a clamp plate 53. Clamp plate 53 is similar to clamp plate 3 of FIG. 1. Housing 70 is similar to housing 20 of FIG. 1; however, in this embodiment, housing 70 does not have an extension member. Rather, in this embodiment, an actuator 57 comprises an extension member 58. The extension member 58 may be integrally formed with the armature 57 or may be a separate piece attached to the armature 57. Such attachment may be, for example, a weld, an adhesive, a fastener, or the like. A gap 59 is formed between an interior surface 58*a* of the extension member 58 and an outer peripheral surface 70*a* of the housing 70. A recess 80 is formed in the outer peripheral surface 70*a* of the housing 70 and helps define the gap 59. In this manner, the recess 80 increases the width of the gap 59 so as to be greater than the width of the remaining portion of the gap 59. The magnetic flux lines generated by the solenoid coil are concentrated in the region of the gap 59, thereby increasing the initial force on armature 57.

It should be appreciated that, in addition to the recess 80, other recesses may be formed in the outer peripheral surface 70*a* of the housing 70. In addition to, or in lieu of, recesses (such as recess 80), the outer peripheral surface 70*a* of the housing 70 may be provided with one or more protrusions. A recess (such as recess 80) or a protrusion creates an irregularity in the outer peripheral surface 70*a* that concentrates the magnetic flux by channeling the flux to a particular location. In addition to, or in lieu of, the irregularity (such as recess 80) in the outer peripheral surface 70*a* of the housing, one or more irregularities may be formed in the interior surface 58*a* of the extension member 58. For example, one or more recesses and/or one or more protrusions may be formed in the interior surface 58*a* of the extension member 58.

It should further be appreciated that irregularities (such as protrusions or recesses) may be formed in the armatures and/or extensions of the other actuator embodiments disclosed herein.

Figure 6:
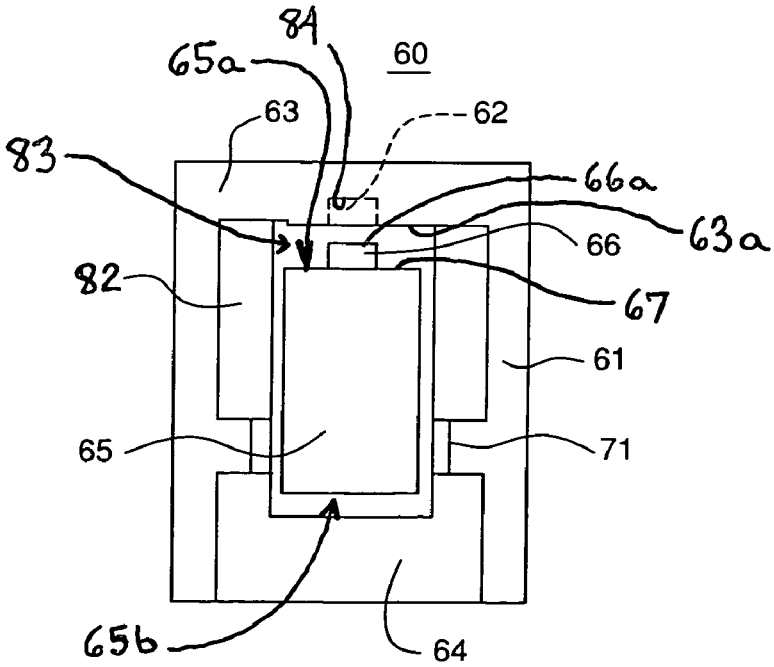
FIG. 6 is a cut-away view of another illustrative electromagnetic actuator, in accordance with another embodiment of the invention.

FIG. 6 shows another illustrative embodiment of the invention. As shown in FIG. 6, electromagnetic actuator 60 comprises a housing 61, an armature 65, and a solenoid coil 82.

Solenoid coil 82 is similar to solenoid coil 5 of FIG. 1. As shown, solenoid coil 82 is disposed within a cavity 83 defined by housing 61.

Electromagnetic actuator 60 also comprises a permanent magnet 71. Permanent magnet 71 is substantially annularly shaped and has an axial passage for armature 65; however, permanent magnet 71 may be any suitable shape. Permanent magnet 71 is aligned such that its magnetic poles provide a magnetic force biasing armature 65. Permanent magnet 71 is used with one technique for stroking actuator 60, but may be omitted with other techniques.

Armature 65 comprises magnetically permeable material and a protrusion or extension member 66. Extension member 66 extends toward an end cap 63 of housing 61, thereby defining a gap between extension member 66 and housing 61. The gap is less than would otherwise exist and increases the initial force of electromagnetic actuator 60, as described above. Extension member 66 is cylindrical and may be integrally formed with armature 65 or may be a separate piece attached to armature 65. Armature 65 is substantially cylindrically shaped and is disposed radially inward of the solenoid coil 82; however armature 65 may be any shape to cooperate with solenoid coil 82 to produce axial motion. Armature 65 is disposed between end caps 63 and 64 of housing 61. End caps 63 and 64 limit the axial travel of armature 65.

The armature 65 includes opposing first and second ends 65*a*, 65*b*. The first end 65*a* includes an annular surface 67 disposed around the extension member 66. The extension member 66 extends away from the annular surface 67 and includes an end surface 66*a*. In this manner, the annular surface 67 and the end surface 66*a* comprise two non-coplanar surfaces of the first end 65*a* of the armature 65, with the annular surface 67 being disposed closer to the second end 65*b* of the armature 65 than the end surface 66*a*. As shown in FIG. 6, the annular surface 67 and the end surface 66*a* are parallel to each other.

Housing 61 is substantially annularly shaped and defines the cavity 83 that contains solenoid coil 82, permanent magnet 71, and armature 65. Housing 61 also comprises the end caps 63 and 64 that substantially enclose armature 65. The end cap 63 has an annular surface 63*a* that is disposed around a recess 62 for receiving extension member 66 of armature 65. The recess 62 is cylindrical and is partially defined by a recessed interior surface 84 that is disposed farther away from the armature 65 than the annular surface 63*a*. In this manner, the annular surface 63*a* and the interior surface 84 are non-coplanar. The annular surface 63*a* and the interior surface 84 are, however, parallel to each other. Housing 61 and recess 62 may be any suitable shape that can cooperate with extension member 66 of armature 65. In other embodiments, housing 61 may comprise an extension member and armature 65 may comprise a recess for receiving the extension member.

The armature 65 is movable between a first position disposed proximate to the end cap 63 of the housing 61 and a second position disposed distal to the end cap 63 of the housing. When the armature 65 is in the first position, the extension member 66 of the armature 65 is disposed in the recess 62 of the end cap 63. With the extension member 66 so positioned, the annular surface 63*a* of the end cap 63 is disposed closer to the second end 65*b* of the armature 65 than the end surface 66*a* of the extension member 66. When the armature 65 is in the second position (as shown in FIG. 6), the extension member 66 is spaced from the end cap 63.

The irregular configuration of the first end 65*a* of the armature 65 and the end cap 63 concentrates the magnetic flux by channeling the flux into the recess 62, thereby increasing the initial force of the actuator 60.

Figure 7:
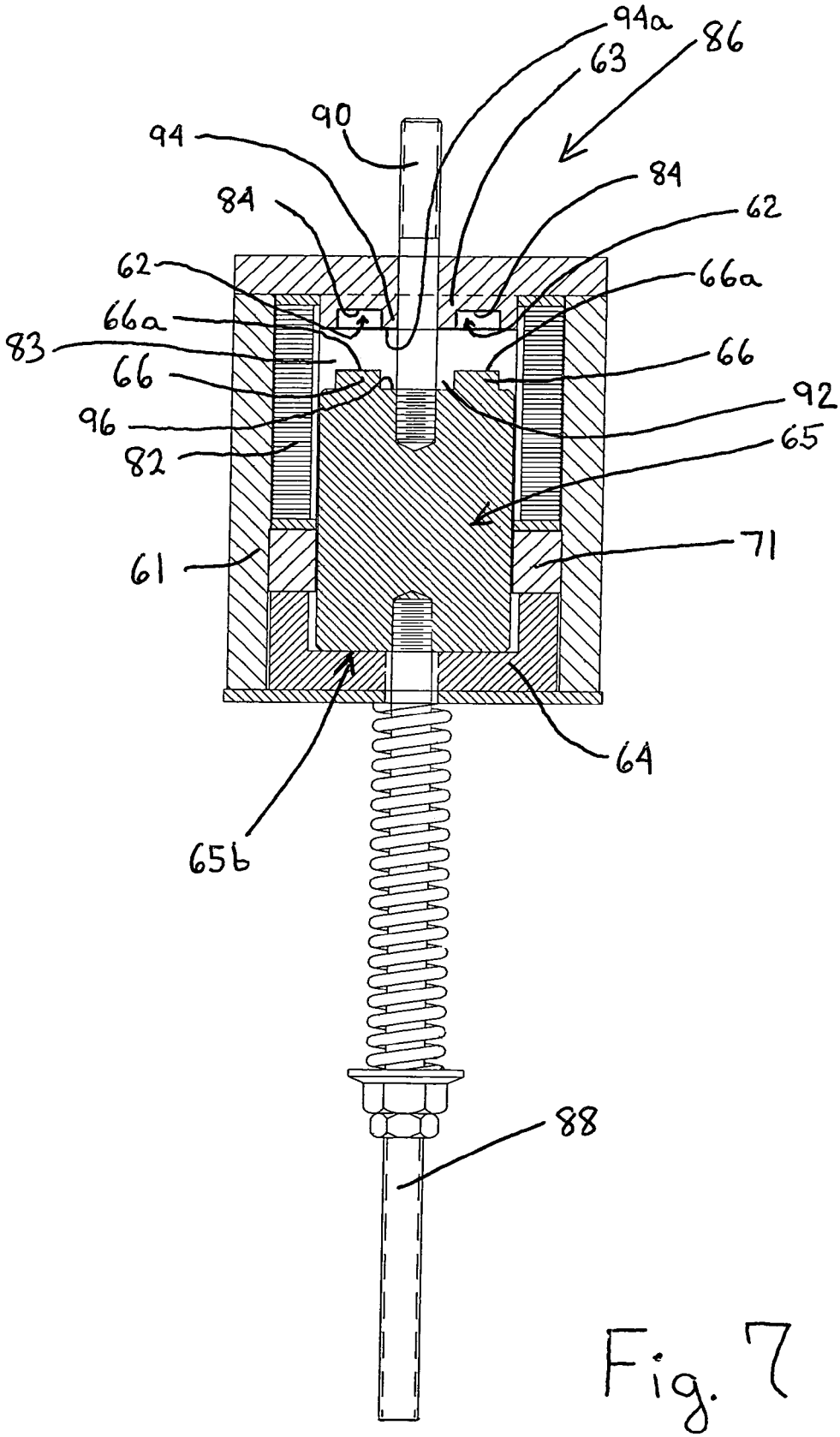
FIG. 7 is a cut-away view of another illustrative electromagnetic actuator in accordance with another embodiment of the invention, wherein an armature of the actuator is in a second position.
Figure 8:
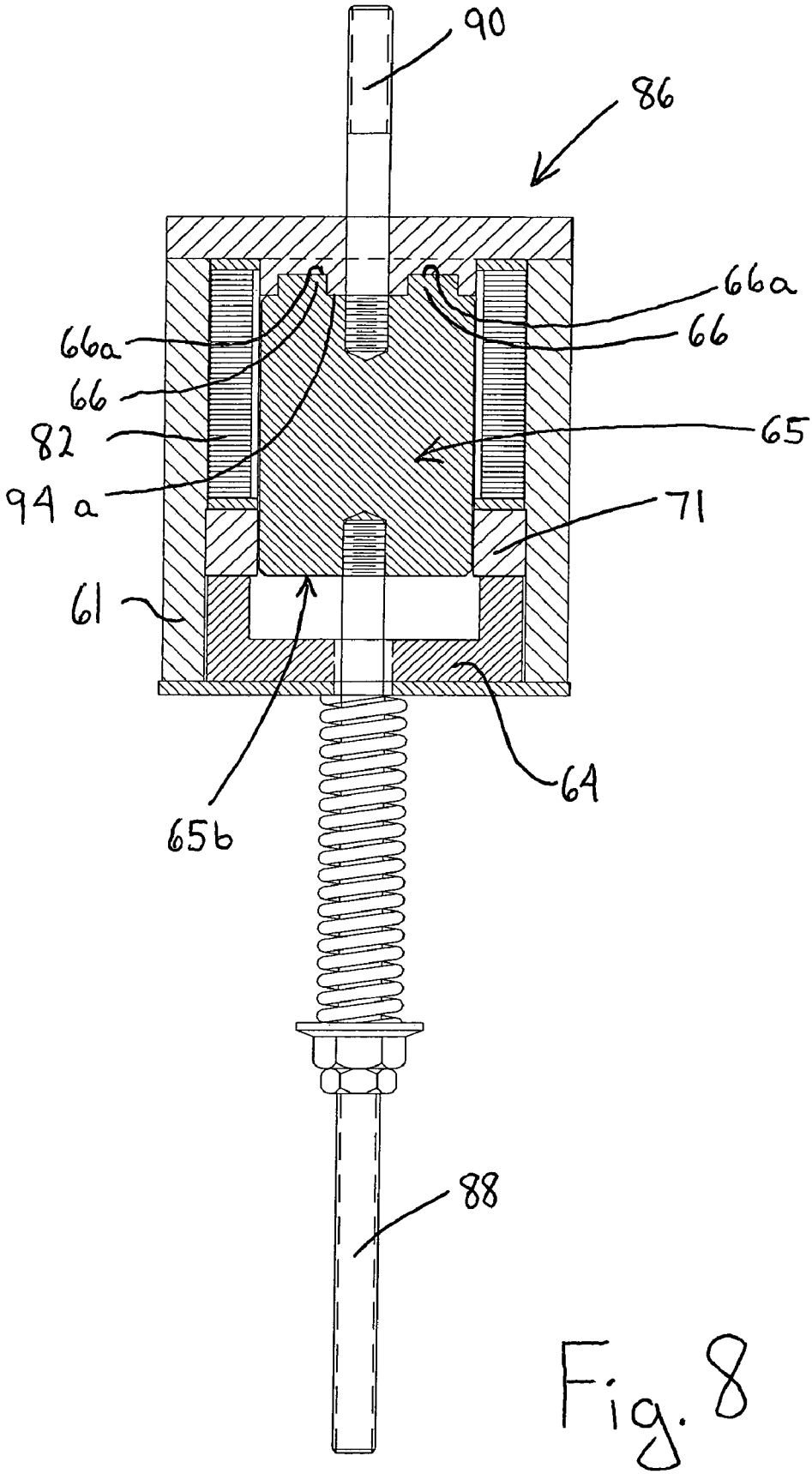
FIG. 8 is a cut-away view of the electromagnetic actuator of FIG. 7, wherein the armature of the actuator is in a first position.

Referring now to FIGS. 7 and 8, there is shown an actuator 86 having substantially the same construction and operation as the actuator 60, except for the differences set forth below. Due to the similarity of construction, components of the actuator 86 that are substantially the same as in the actuator 60 will have the same reference numerals. Instead of having only one extension member 66 extending from the armature 65 and only one recess 62 in the end cap 63, as in the actuator 60, the actuator 86 has a pair of extension members 66 extending from the armature 65 and a pair of recesses 62 in the end cap 63. In addition, a rod 88 is secured to the armature 65 and extends from the second end 65*b* thereof and a rod 90 is secured to the armature 65 and extends from the first end 65*a* thereof. The two extension members 66 define a valley 92 therebetween, through which the rod 90 extends. Correspondingly, the recesses 62 in the end cap 63 form a protrusion 94 through which the rod 90 extends. The protrusion 94 has an end surface 94*a*, while the valley 92 is partially defined by an inner surface 96. Since there are two recesses 62 in the end cap 63, the surface 63*a* is not annular, but is, instead irregularly shaped. The surface 63*a* includes the end surface 94*a*.

When the armature 65 is in the first position (as shown in FIG. 8), the extension members 66 of the armature 65 are disposed in the recesses 62 of the end cap 63. In addition, the protrusion 94 of the end cap 63 is disposed in the valley 92. With the extension members 66 so positioned, the surface 63*a* of the end cap 63 is disposed closer to the second end 65*b* of the armature 65 than the end surfaces 66*a* of the extension members 66. When the armature 65 is in the second position (as shown in FIG. 7), the extension members 66 are spaced from the end cap 63.

The recesses 62 and the extension members 66 are configured such that when the armature 65 is in the first position and the extension members 66 are disposed in the recesses 62 and the protrusion 94 is disposed in the valley 92, there are gaps between the interior surfaces 84 and the end surfaces 66*a* and a gap between the inner surface 96 in the valley 92 and the end surface 94*a* of the protrusion 94. Each of these gaps is preferably about 0.005 inches. It has been found that contaminants (such as metal particles) that may enter or form in the cavity 83 during the operation of the actuator 86 collect in the valley 92. It is believed that the collection of contaminants in the valley 92 improves the latching strength between the armature 65 and the end cap 63. Moreover, the irregular configuration of the first end 65*a* of the armature 65 and the end cap 63 concentrates the magnetic flux by channeling the flux into the recesses 62, thereby increasing the initial force of the actuator 86.

Figure 9:
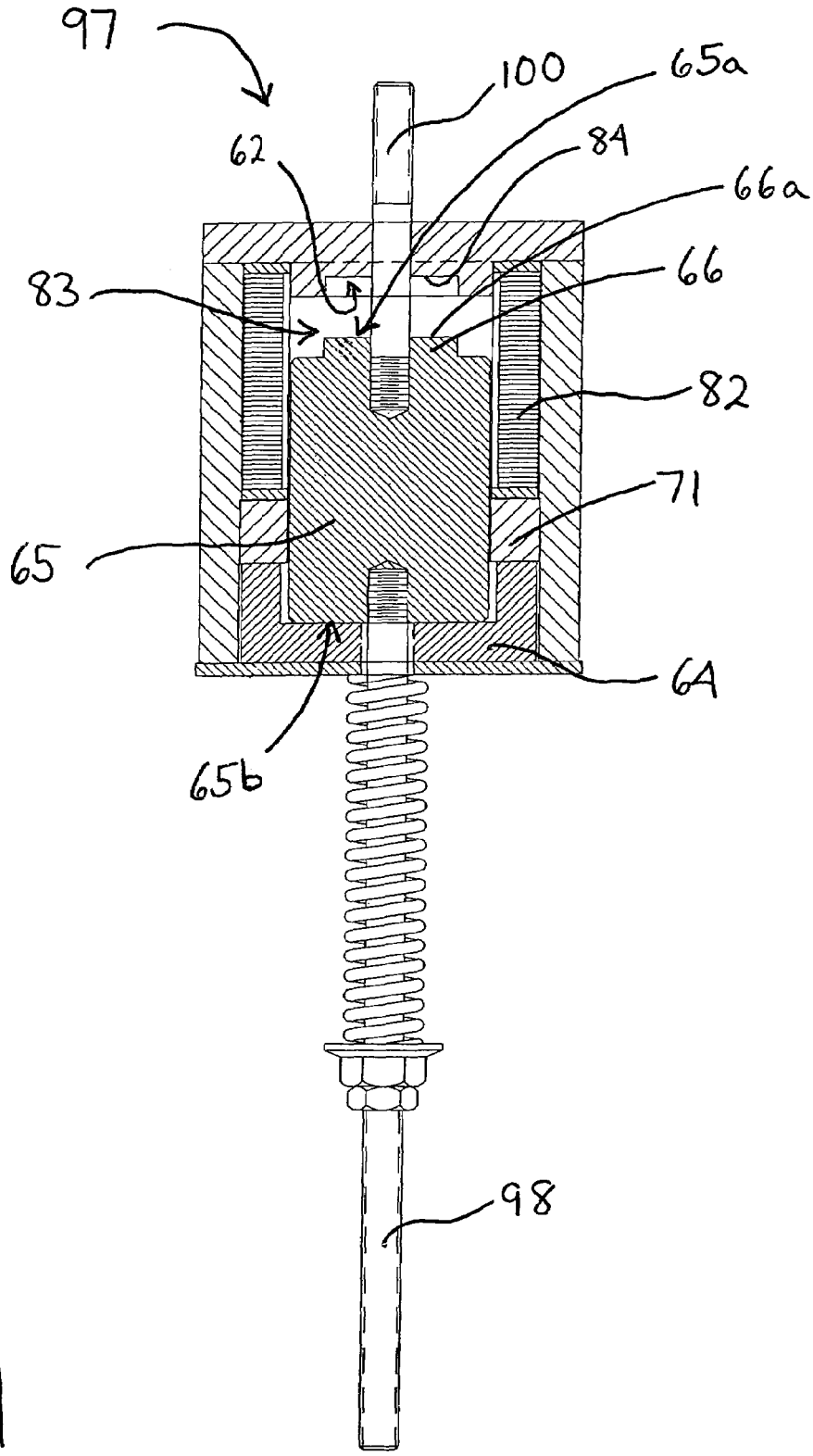
FIG. 9 is a cut-away view of another illustrative electromagnetic actuator in accordance with another embodiment of the invention.

Referring now to FIG. 9, there is shown an actuator 97 having substantially the same construction and operation as the actuator 60, except for the differences set forth below. Due to the similarity of construction, components of the actuator 97 that are substantially the same as in the actuator 60 will have the same reference numerals. A rod 98 is secured to the armature 65 and extends from the second end 65*b* thereof and a rod 100 is secured to the armature 65. The rod 100 extends through the recess 62 and the extension member 66.

Figure 10:
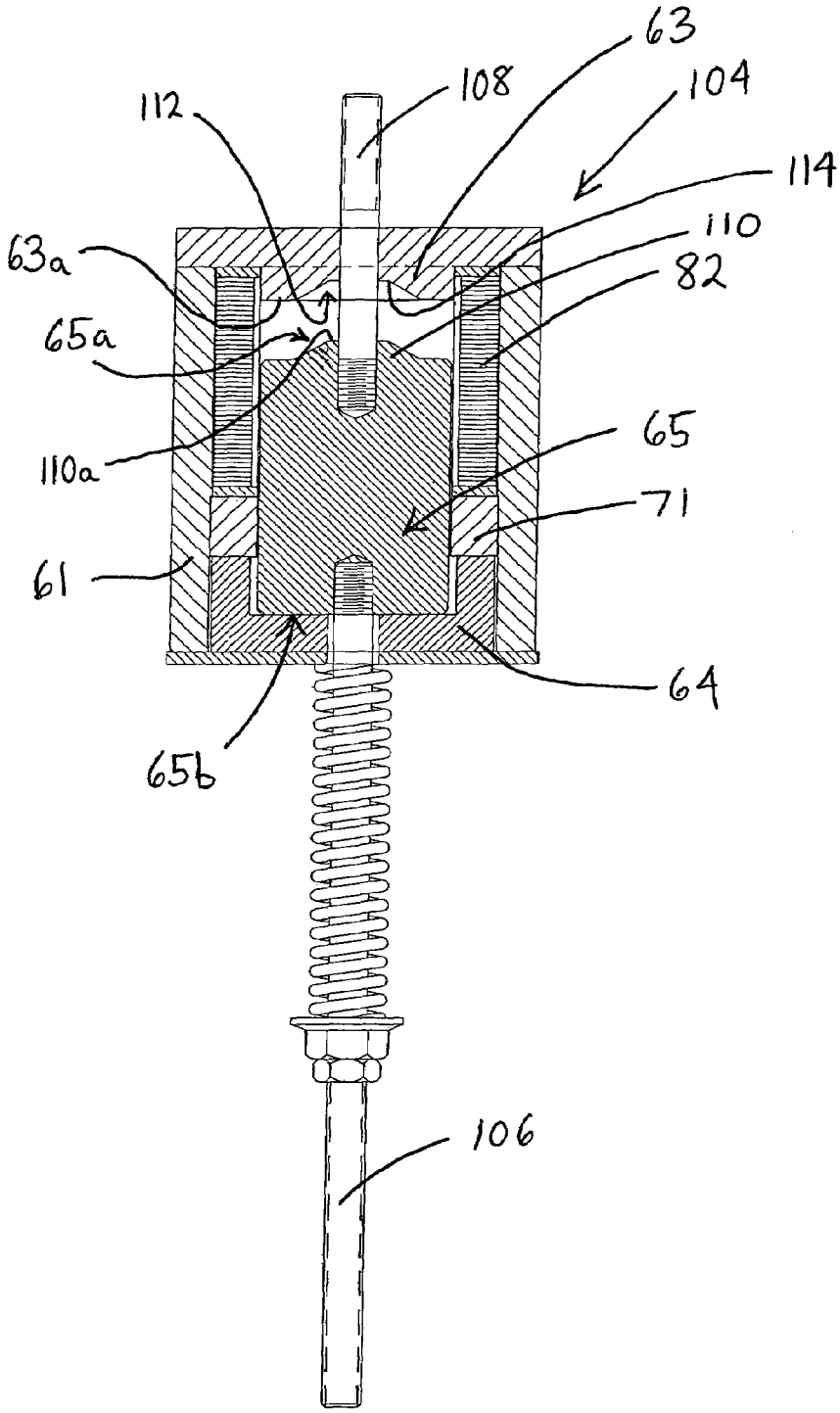
FIG. 10 is a cut-away view of another illustrative electromagnetic actuator in accordance with another embodiment of the invention.

Referring now to FIG. 10, there is shown an actuator 104 having substantially the same construction and operation as the actuator 60, except for the differences set forth below. Due to the similarity of construction, components of the actuator 104 that are substantially the same as in the actuator 60 will have the same reference numerals. The actuator 104 does not have the cylindrical extension member 66 and the cylindrical recess 62, as in the actuator 60. Instead, the armature 65 of the actuator 104 has a frusto-conical protrusion 110 and the end cap 63 has a corresponding frusto-conical recess 112. The protrusion 110 has a frusto-conical outer surface 110*a*, while the recess 112 is defined by a frusto-conical interior surface 114. A rod 106 is secured to the armature 65 and extends from the second end 65*b* thereof and a rod 108 is secured to the armature 65 and extends from the first end 65*a* thereof. The rod 108 extends through the recess 112 and the protrusion 110.

When the armature 65 is in the first position, the protrusion 110 of the armature 65 is disposed in the recess 112 of the end cap 63, with a small gap being formed between the outer surface 110*a* of the protrusion 110 and the interior surface 114 of the recess 112. When the armature 65 is in the second position (as shown in FIG. 10), the protrusion 110 is spaced from the end cap 63.

Figure 11:
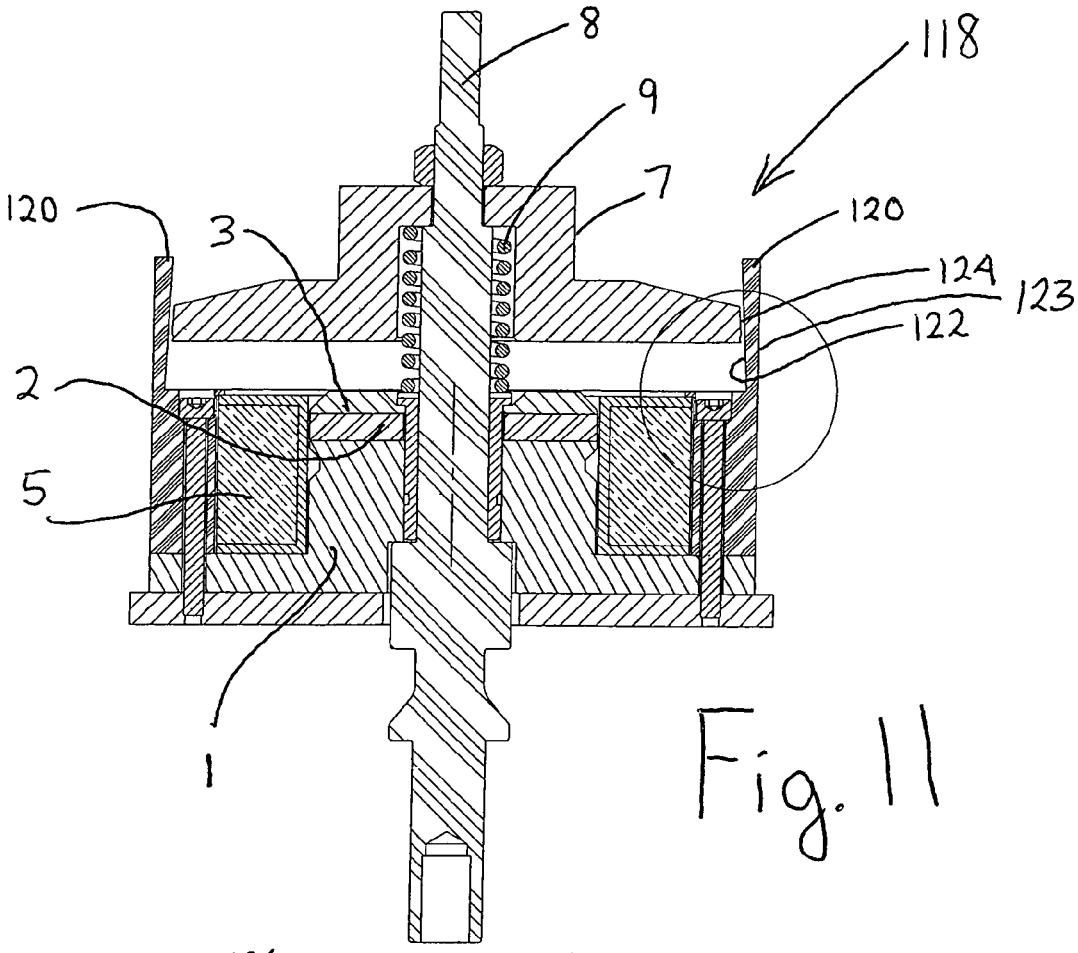
FIG. 11 is a cut-away view of another illustrative electromagnetic actuator in accordance with another embodiment of the invention.
Figure 12:
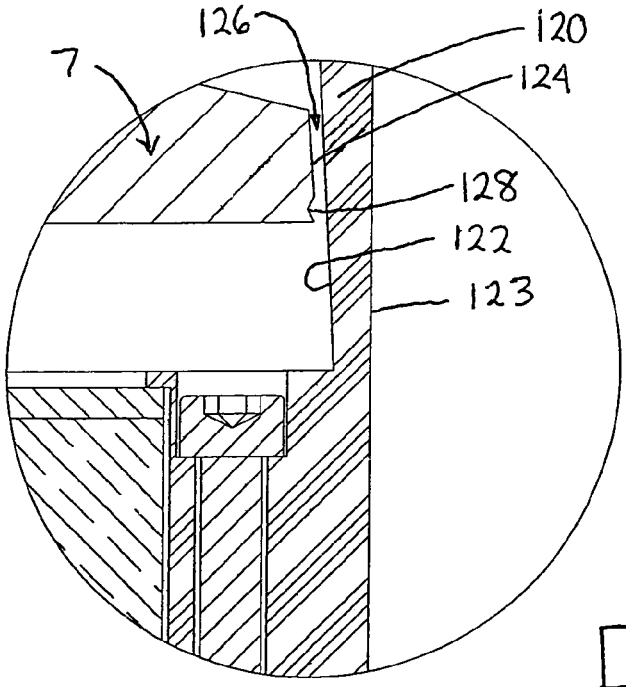
FIG. 12 is a close-up view of a portion of the electromagnetic actuator of FIG. 11.

Referring now to FIGS. 11 and 12, there is shown an actuator 118 having substantially the same construction and operation as the actuator 30, except for the differences set forth below. Due to the similarity of construction, components of the actuator 118 that are substantially the same as in the actuator 30 will have the same reference numerals. The actuator 118 does not have the extension member 21, as in the actuator 30. Instead, the actuator 118 has an annular extension member 120 with an interior surface 122 and an exterior surface 123. In addition, the armature 7 does not have the outer surface 25, as in the actuator 30. Instead, the armature 7 has an outer peripheral surface 124.

The interior surface 122 of the extension member 120 slopes slightly outward as it extends downwardly from an upper rim of the extension member 120 toward the clamp plate 3. As a result, in a plane extending in a direction radially outward from the longitudinal axis of the shaft 8, the interior surface 122 of the extension member 120 is non-parallel to the exterior surface 123 of the extension member 120 and to the longitudinal axis of the shaft 8. The outer peripheral surface 124 of the armature 7 also slopes slightly outward as it extends downwardly toward the clamp plate 3. As a result, in a plane extending in a direction radially outward from the longitudinal axis of the shaft 8, the outer peripheral surface 124 of the armature 7 is non-parallel to the longitudinal axis of the shaft 8. The outer peripheral surface 124 of the armature 7, however, is parallel to the interior surface 122 of the extension member 120. The outer peripheral surface 124 of the armature 7 cooperates with the interior surface 122 of the extension member 120 to define a gap 126 therebetween.

A notch or recess 128 is formed in the outer peripheral surface 124 of the armature 7, toward a lower corner of the armature 7. The recess 128 extends radially inward toward the longitudinal axis of the shaft 8 and helps define the gap 126. In this manner, the recess 128 increases the width of the gap 126 so as to be greater than the width of the remaining portion of the gap 126. The outward slope of the interior surface 122 of the extension member 120 helps to channel magnetic flux into the recess 128, thereby increasing the initial force of the actuator 118.

It is to be understood that the foregoing description has been provided merely for the purpose of explanation and is in no way to be construed as limiting of the invention. Where the invention has been described with reference to embodiments, it is understood that the words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

What is claimed is:

1. An electromagnetic actuator comprising:

a housing defining a cavity;

a shaft extending through the housing and having a longitudinal axis;

a solenoid coil disposed in the cavity of the housing and having a center axis that is substantially coaxial with the longitudinal axis of the shaft;

a clamp surface;

an armature secured to the shaft and extending outward from the shaft to an outer peripheral surface, wherein said armature is movable between a first position disposed proximate to the damp surface and a second position disposed distal to the clamp surface, wherein when the armature is in the first position, the armature and the housing define a first gap therebetween, said first gap having a plurality of different widths that extend between the armature and the housing in directions perpendicular to the longitudinal axis of the shaft, wherein when the armature is in the second position, the armature and the clamp surface define a longitudinally-extending second gap therebetween, said second gap having a width in the direction of the longitudinal axis of the shaft, and wherein the widths of the first gap are all smaller than the width of the second gap.

2. The electromagnetic actuator of claim 1, wherein the first gap is formed between the outer peripheral surface of the armature and an interior surface of the housing.

3. The electromagnetic actuator of claim 2, wherein the outer peripheral surface of the armature is non-parallel to the interior surface of the housing.

4. The electromagnetic actuator of claim 3, wherein in a plane extending in a direction radially outward from the longitudinal axis of the shaft, the outer peripheral surface of the armature is parallel with the longitudinal axis of the shaft and the interior surface of the housing is non-parallel with the longitudinal axis of the shaft.

5. The electromagnetic actuator of claim 3, wherein the greatest width of the first gap is disposed proximate to the clamp surface, and the smallest width of the first gap is disposed distal to the clamp surface.

6. The electromagnetic actuator of claim 3, wherein the greatest width of the first gap is disposed distal to the clamp surface, and the smallest width of the first gap is disposed proximate to the clamp surface.

7. The electromagnetic actuator of claim 2, wherein the outer peripheral surface of the armature has a recess fanned therein, said recess helping to define the first gap.

8. The electromagnetic actuator of claim 7, wherein the outer peripheral surface of the armature is parallel to the interior surface of the housing.

9. The electromagnetic actuator of claim 8, wherein in a plane extending in a direction radially outward from the longitudinal axis of the shaft, the outer peripheral surface of the armature and the interior surface of the housing are non-parallel to the longitudinal axis of the shaft.

10. The electromagnetic actuator of claim 1, wherein the armature has an extension extending in the direction of the longitudinal axis of the shaft, and wherein the first gap is formed between an interior surface of the extension and an outer peripheral surface of the housing.

11. The electromagnetic actuator of claim 10, wherein a recess is formed in the outer peripheral surface of the housing and helps define the first gap, and wherein the greatest width of the first gap extends through the recess.

12. The electromagnetic actuator of claim 1, wherein the clamp surface comprises a clamp plate and wherein the electromagnetic actuator further comprises a permanent magnet disposed radially inward from the solenoid coil.

13. The electromagnetic actuator of claim 1, further comprising a spring disposed in the housing and operable to bias the armature toward the second position.

14. The electromagnetic actuator of claim 1, wherein at least a portion of the armature is disposed exterior to the housing.

15. The electromagnetic actuator of claim 11, wherein a second recess is formed in the outer peripheral surface of the housing and helps define the first gap.

* * * * *